US008796954B2

(12) United States Patent
Zhang et al.

(10) Patent No.: US 8,796,954 B2
(45) Date of Patent: Aug. 5, 2014

(54) DIMMING CONTROL FOR ELECTRONIC LAMP

(75) Inventors: Wanfeng Zhang, Palo Alto, CA (US); Radu Pitigoi-Aron, San Jose, CA (US); Daniel Reed, Sunnyvale, CA (US)

(73) Assignee: Marvell World Trade Ltd., St. Michael (BB)

( * ) Notice: Subject to any disclaimer, the term of this patent is extended or adjusted under 35 U.S.C. 154(b) by 175 days.

(21) Appl. No.: 13/272,446

(22) Filed: Oct. 13, 2011

(65) Prior Publication Data

US 2012/0091910 A1 Apr. 19, 2012

Related U.S. Application Data

(60) Provisional application No. 61/392,790, filed on Oct. 13, 2010, provisional application No. 61/437,511, filed on Jan. 28, 2011.

(51) Int. Cl.
*H05B 37/02* (2006.01)
*H05B 39/04* (2006.01)

(52) U.S. Cl.
USPC ..... 315/307; 315/315

(58) Field of Classification Search
CPC ..... H05B 33/0815; H05B 41/28; H05B 41/3925; H05B 41/2828; H05B 41/3921; H05B 41/3927; H05B 33/0818; H05B 37/02; H05B 37/0263; H05B 41/2824; H05B 41/2985; H05B 41/3924; H05B 33/0851; H05B 41/29
USPC ..... 315/307
See application file for complete search history.

(56) References Cited

U.S. PATENT DOCUMENTS

2009/0261748 A1 10/2009 McKinney et al.
2010/0060181 A1* 3/2010 Choi et al. ..... 315/224
2010/0134038 A1 6/2010 Shackle et al.
2010/0156319 A1 6/2010 Melanson

FOREIGN PATENT DOCUMENTS

CN 1618048 A 5/2005

OTHER PUBLICATIONS

International Search Report, PCT Application No. PCT/US2012/056078, mailed Feb. 13, 2012.

* cited by examiner

*Primary Examiner* — Douglas W Owens
*Assistant Examiner* — Monica C King

(57) ABSTRACT

In one embodiment, an apparatus includes circuitry configured to receive a dimming input to control a dimming level of a lamp. Also, the apparatus includes circuitry configured to generate a control signal based on the dimming input. The control signal indicates the dimming level for a converter of the lamp and the converter is configured to interpret the control signal to control to the dimming level of the lamp using a sinusoidal signal.

20 Claims, 12 Drawing Sheets

FIG. .7

DIMMING CONTROL FOR ELECTRONIC LAMP

CROSS REFERENCE TO RELATED APPLICATIONS

The present disclosure claims priority to U.S. Provisional App. No. 61/392,790 for "Dimming Method and Implementation for Electronic lamp (LED and/or Fluorescent Lighting" filed Oct. 13, 2010 and U.S. Provisional App. No. 61/437,511 for "TRIAC Communication Method for LED Lamp Dimming Without Chopping AC Power Line Voltage" filed Jan. 28, 2011, both of which are incorporated herein by reference in their entirety for all purposes.

BACKGROUND

Particular embodiments generally relate to dimming of electronic lamps.

Unless otherwise indicated herein, the approaches described in this section are not prior art to the claims in this application and are not admitted to be prior art by inclusion in this section.

A dimmer, which includes a triode for alternating current (TRIAC), is used for dimming of incandescent lamps. The dimmer may use forward or reverse phase control. Both phase control schemes chop an alternating current (AC) line voltage either at the beginning of the half sine waveform (forward phase control) or at the end of the half sine waveform (reverse phase control). This stops the power delivered to the incandescent lamp for an adjustable/controllable part of the sine waveform, which is referred to as a non-conduction angle. The conduction angle is the part of the sine waveform where power is delivered. The ratio between the conduction portion and the full waveform defines the dimming level.

The above type of dimming uses the characteristics of the TRIAC. For example, the TRIAC can be turned on at a controlled moment and after that, the TRIAC stays in full conduction until the current through the TRIAC goes under a sustaining level in either direction. For example, when the sine waveform crosses zero, the current goes below the sustaining level and the TRIAC is turned off.

FIG. 1 depicts an example of a dimming circuit 100. A phase control circuit 106 is used to trigger a DIAC 105 at a controlled moment, the DIAC 105 then turns on the TRIAC 104. To operate phase control circuit 106, a variable resistor R, and a capacitor C are mounted in series with an incandescent lamp 102. Incandescent lamp 102 acts as a resistive load and offers a continuous path to ground that allows current to flow through variable resistor R and capacitor C when TRIAC 104 is turned off. This allows a continuous flow of current that charges capacitor C in a desired amount of time that is set by variable resistor R. When capacitor C builds up a certain amount of charge and its voltage reaches the breakover voltage of DIAC 105, TRIAC 104 begins to conduct and turns on incandescent lamp 102. The amount of time is set based on the conduction angle that is desired. A dimmer switch knob or slider could be used to control the conduction angle.

When a light-emitting diode (LED) lamp is used instead of incandescent lamp 102, LED lamp is driven by an electronic circuit that mainly includes a power converter and control circuits. Issues result when the LED lamp is used with TRIAC 104, such as flicker, in-rush current, dead travel, pop-on, etc. These issues may result because TRIACs were designed to drive a resistive load, such as incandescent lamp 102, instead of an electronic load, such as an LED. When forward phase control is used, a big inrush of current occurs when conduction begins. This is because a voltage level suddenly increases from zero to a high level. FIG. 2 shows an example of a graph 200 showing a forward phase control waveform according to one embodiment. In a first section 202, TRIAC 104 is not conducting. At 204, TRIAC 104 begins conducting. At this point, the voltage goes from zero to a high level at 206. The shaded part indicates the time in which TRIAC 104 is conducting. The inrush current may create noise in the system and also a large oscillation that may lead to TRIAC 104 turning off improperly.

Another disadvantage with using TRIAC 104 is that dimming the LED lamp using the electronic circuit that drives the LEDs may be difficult using TRIAC 104 because TRIAC 104 needs a hold current as several milliamps (mA) to several tens of milliamps. When the current through TRIAC 104 is lower than the hold current, TRIAC 104 will shut down. Therefore, current to hold TRIAC 104 on when the LED goes into a deep dimming level is not enough, which makes it hard to control the LED lamp when it goes into a deep dimming condition. This may also cause a pop-on condition where the LED lamp is turned off under deep dimming level. The LED lamp cannot be turned on from that dimming level until setting the dimming level back to a high dimming level, which causes the LED lamp to suddenly pop on.

Also, the current waveform input into the LED lamp intrinsically has high harmonics when the voltage waveform is conducted as shown in FIG. 2. These high harmonics eventually make it back to a power system for the LED lamp and create issues for power transmission, such as high losses and noise pollution for other electronic devices in the LED lamp.

SUMMARY

In one embodiment, an apparatus includes circuitry configured to receive a dimming input to control a dimming level of a lamp. Also, the apparatus includes circuitry configured to generate a control signal based on the dimming input. The control signal indicates the dimming level for a converter of the lamp and the converter is configured to interpret the control signal to control to the dimming level of the lamp using a sinusoidal signal.

In one embodiment, the circuitry configured to generate the control signal is further configured to modulate an input signal using a modulation signal that is generated based on the dimming input, the modulation signal including dimming information for the dimming level.

In one embodiment, the control signal includes a pattern based on a non-conduction angle to indicate a start signal In one embodiment, an apparatus includes circuitry configured to receive a control signal based on a dimming input to control a dimming level of a lamp. Also, the apparatus includes circuitry configured to interpret the control signal to determine the dimming level for a converter of the lamp. Further, the apparatus includes circuitry configured to control the dimming level of the lamp by adjusting a dimming level for a load of the lamp using a sinusoidal signal.

In one embodiment, a method includes receiving a dimming input to control a dimming level of a lamp; and generating a control signal based on the dimming input, wherein the control signal indicates the dimming level for a converter of the lamp, the converter configured to interpret the control signal to control to the dimming level of the lamp using a sinusoidal signal.

In one embodiment, a method includes receiving a control signal based on a dimming input to control a dimming level of a lamp; interpreting the control signal to determine the dimming level for a converter of the lamp; and controlling the dimming level of the lamp by adjusting a dimming level for a load of the electronic lamp using a sinusoidal signal.

The following detailed description and accompanying drawings provide a more detailed understanding of the nature and advantages of the present invention.

DETAILED DESCRIPTION

Described herein are techniques for a dimming control system for an electronic lamp. In the following description, for purposes of explanation, numerous examples and specific details are set forth in order to provide a thorough understanding of embodiments of the present invention. Particular embodiments as defined by the claims may include some or all of the features in these examples alone or in combination with other features described below, and may further include modifications and equivalents of the features and concepts described herein.

Overview

Figure 3:
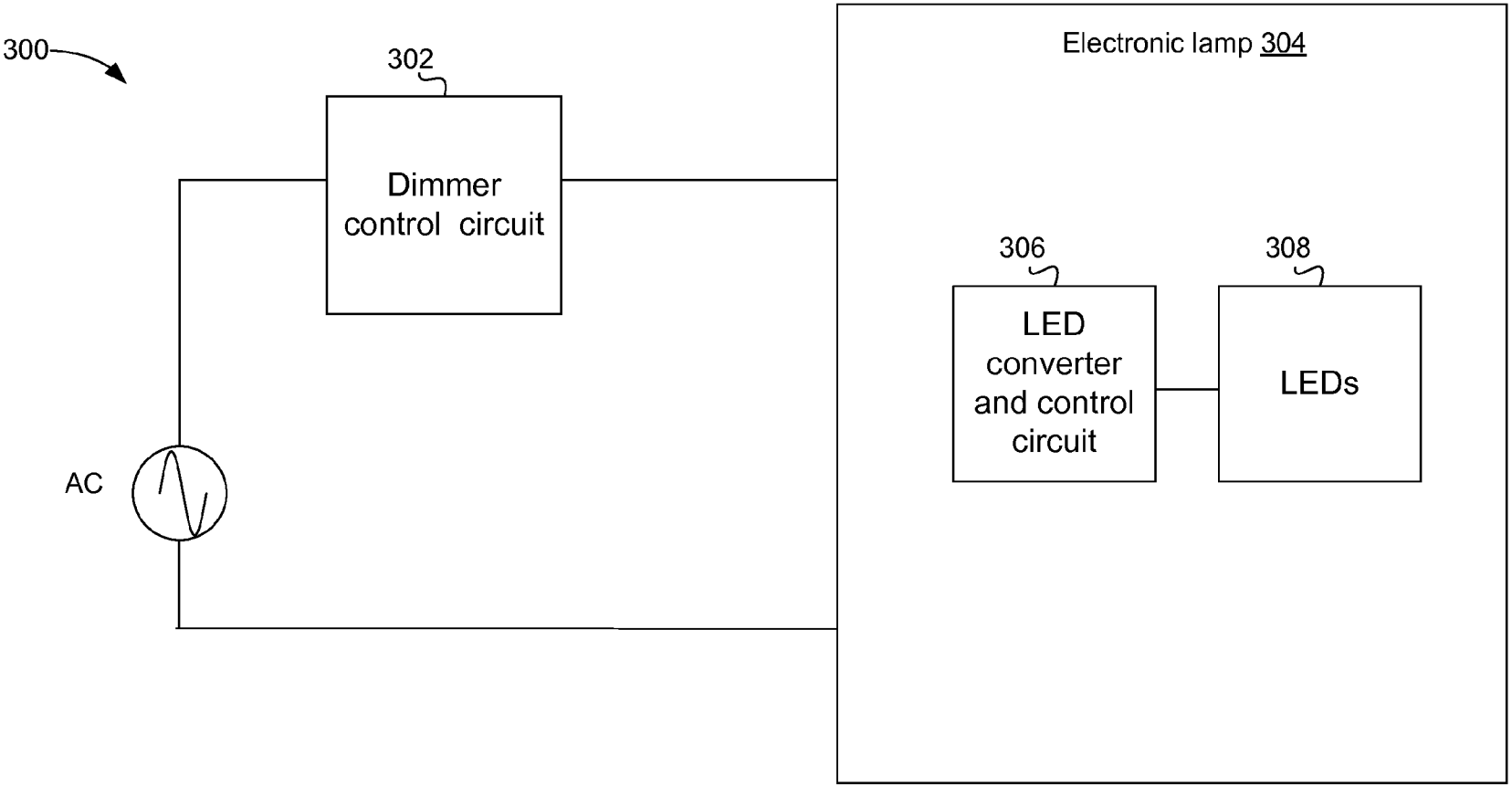
FIG. 3 depicts a system for dimming an electronic lamp according to one embodiment.

FIG. 3 depicts a system 300 for dimming an electronic lamp 304 according to one embodiment. Electronic lamp 304 may include one or more electronic loads, such as LEDs. A dimmer control circuit 302 is coupled to the AC line voltage input signal (AC). Dimmer control circuit 302 receives a dimming input that controls a dimming level of electronic lamp 304. For example, the input is received from a wall control unit. Dimmer control circuit 302 then generates a control signal based on the dimming input that indicates a dimming level for electronic lamp 304. In one embodiment, the AC line voltage input signal is modulated based on the dimming input. The modulated signal is then used by an LED converter and control circuit 306 to determine the dimming level. For example, the modulation signal carries dimming information for the dimming level. In another embodiment, dimming information for the dimming level is embedded in the control signal. For example, a start pattern using a non-conduction angle is included in the control signal. This indicates to LED converter and control circuit 306 that the dimming information will be included in the control signal in the next line cycle. The non-conduction angle of the next line cycle is then used to determine the dimming level. For example, an off time of the control signal is used to determine the dimming level.

LED converter and control circuit 306 receives the control signal and then adjusts the dimming level of LEDs 308. For example, the level may be adjusted by current amplitude dimming, pulse-width modulation (PWM) dimming, or other methods. In one embodiment, the dimming method does not use forward phase control or reverse phase control to stop the power delivered to LEDs 308. Rather, the power delivered to LEDs 308 is a sinusoidal signal.

Modulation Embodiment

Figure 4:
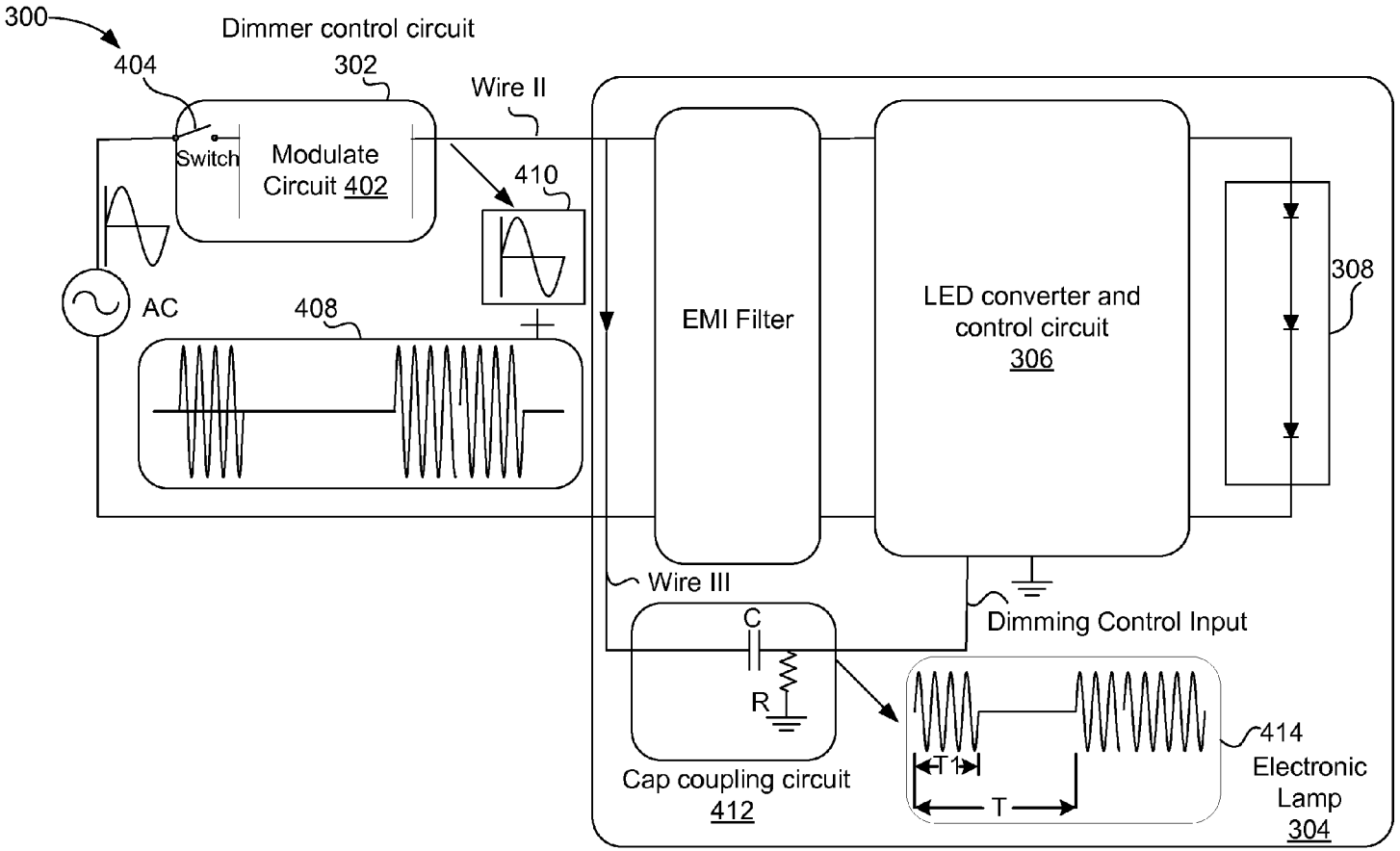
FIG. 4 depicts a more detailed example of the system for using modulation according to one embodiment.

FIG. 4 depicts a more detailed example of system 300 for using modulation according to one embodiment. Dimmer control circuit 302 includes a modulate circuit 402 and a switch 404. Switch 404 is used to turn electronic lamp 304 on and off. Although electronic lamps are discussed, particular embodiments may also work with incandescent lamps. Modulate circuit 402 generates a high frequency modulation signal that carries the dimming information for the dimming level. Modulate circuit 402 receives the AC line voltage input signal and modulates the input signal using a modulation signal based on a dimming input. For example, depending on the inputted dimming level, the modulation signal is generated differently. The AC line voltage input signal is shown at 410 and the modulation signal is shown at 408. The amplitude of a modulation signal at 408 is very small and the frequency is high compared to the AC line voltage input signal shown at 410. The modulation signal is used to modulate the AC line voltage input signal to generate the control signal. The control signal carries dimming information for the dimming level to electronic lamp 304. The control signal that is output onto a wire II is a line frequency sinusoid waveform shown at 410 carrying a high frequency sinusoid waveform as shown at 408.

The control signal including the AC line voltage input signal and modulation signal is input on a wire III into a capacitor coupling circuit 412. Capacitor coupling circuit 412 couples the control signal to a dimming control input of an LED converter and control circuit 306. As shown at 414, the control signal includes the modulation signal where a first time T1 in which the modulation signal is a high frequency sinusoidal and after which, the modulation signal is low (e.g., 0 volts). A time T is one cycle. A dimming level may be represented as dim_level=T1/T. Thus, by varying the time T1, the dimming level may be adjusted. For example, when the time T1 is increased, the dimming level is increased (i.e., the power delivered to LEDs 308 is increased thereby increasing the intensity). When time T1 is decreased, the dimming level is decreased (i.e., the power delivered to LEDs 308 is decreased thereby lowering the intensity). Although the ratio of T1/T is used, other schemes may be used to determine the dimming level from the modulation signal. For example, the time T1 may be compared to a reference level to determine the dimming level. After the cycle ends, a new cycle starts where the high frequency sinusoidal waveform continues again (or once the dimming level is sent, the modulation may stop.).

Figure 1:
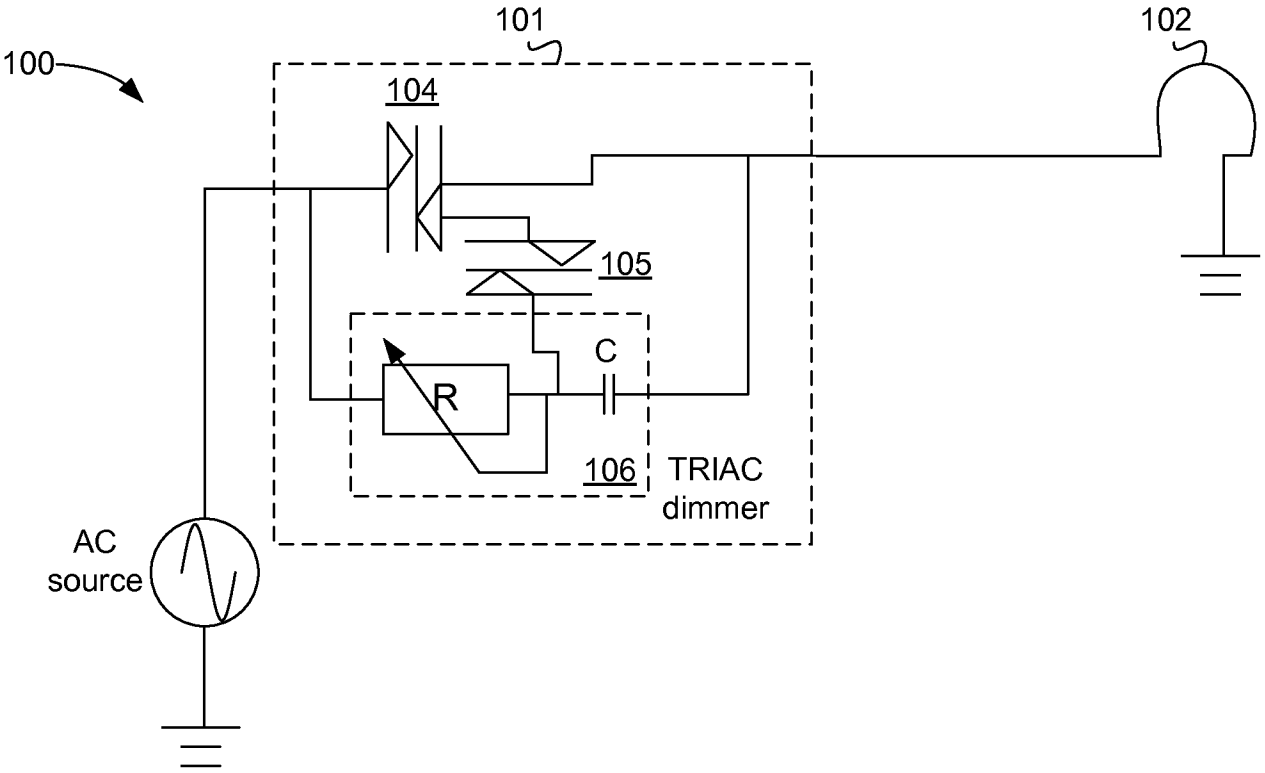
FIG. 1 (prior art)
FIG. 1 depicts an example of a dimming circuit.
Figure 2:
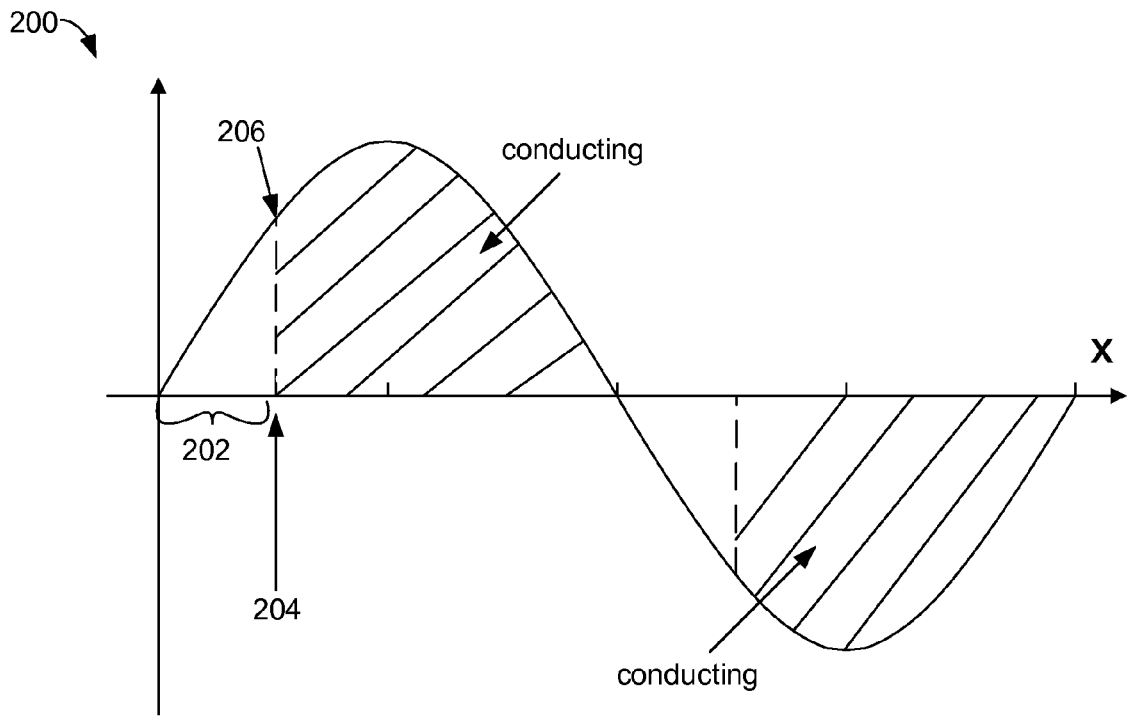
FIG. 2 (prior art)
FIG. 2 shows an example of a graph showing a forward phase control waveform according to one embodiment.
Figure 5:
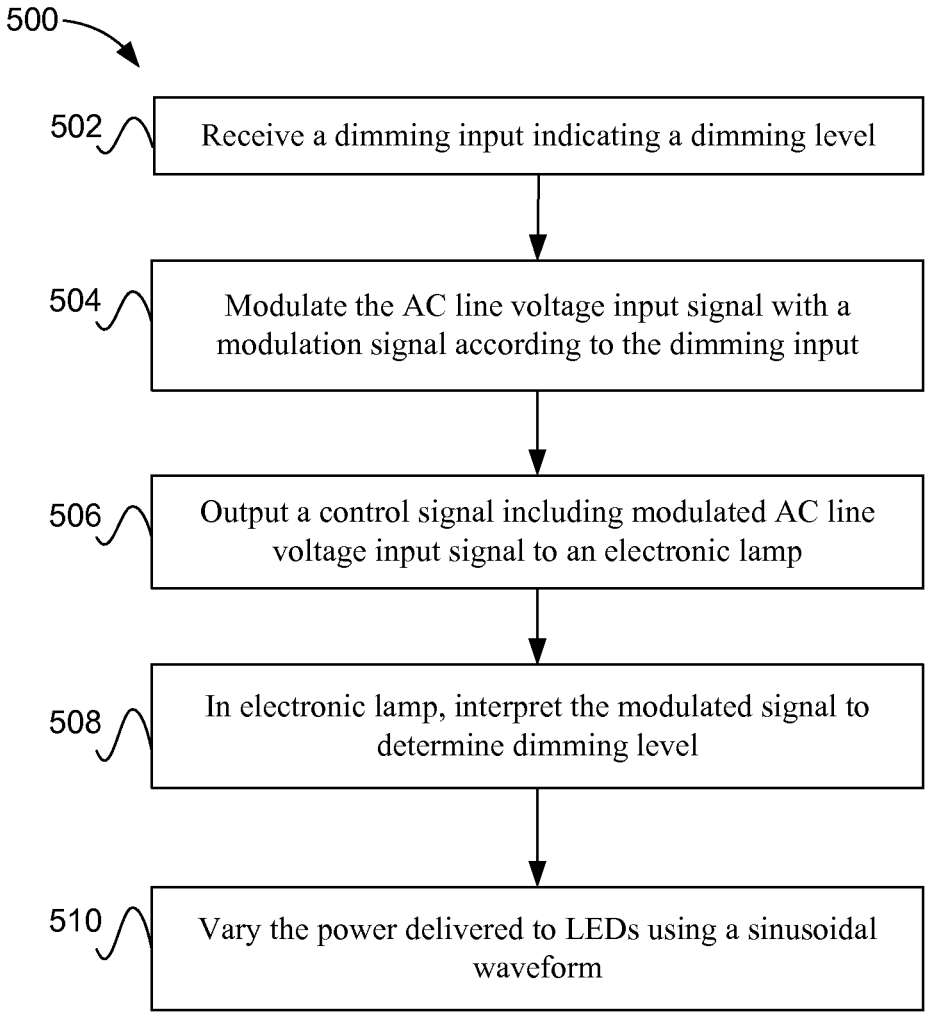
FIG. 5 depicts a simplified flowchart of a method for providing dimming according to one embodiment.

LED converter and control circuit 306 receives the control signal and interprets the modulation signal. A dimming signal delivering power to LEDs 308 is then adjusted according to the dimming level determined from the modulation signal. The current delivered to LED lamp 304 is sinusoidal during the dimming instead of the forward phase control provided in FIG. 2. Because the current delivered to LED lamp 304 is sinusoidal and not cut off, distortion does not result. Additionally, smaller power dissipation and loss is provided as compared to conventional TRIAC dimming FIG. 5 depicts a simplified flowchart 500 of a method for providing dimming according to one embodiment. At 502, modulate circuit 402 receives a dimming input indicating a dimming level. For example, a user may use a wall control unit to indicate the dimming level. At 504, modulate circuit 402 modulates the AC line voltage input signal with a modulation signal according to the dimming input. For example, the modulation signal may include a different time T1 where a high frequency sinusoid signal is output based on the dimming level.

At 506, modulate circuit 402 outputs a control signal including modulated AC line voltage input signal to electronic lamp 304. At 508, in electronic lamp 304, LED converter and control circuit 306 interprets the control signal to determine the dimming level. For example, the time T1 in the modulation signal is used to determine the dimming level. At 510, LED converter and control circuit 306 varies the power delivered to LEDs 308 using a sinusoidal waveform as input to the LED lamp 304.

The embodiment described in FIG. 4 may require an IP address or identifier to apply the dimming to a specific electronic lamp 304. In another embodiment, a dimmer control circuit 302 may be used to control multiple electronic lamps 304.

Non-Conduction Angle Pattern Embodiment

Figure 6:
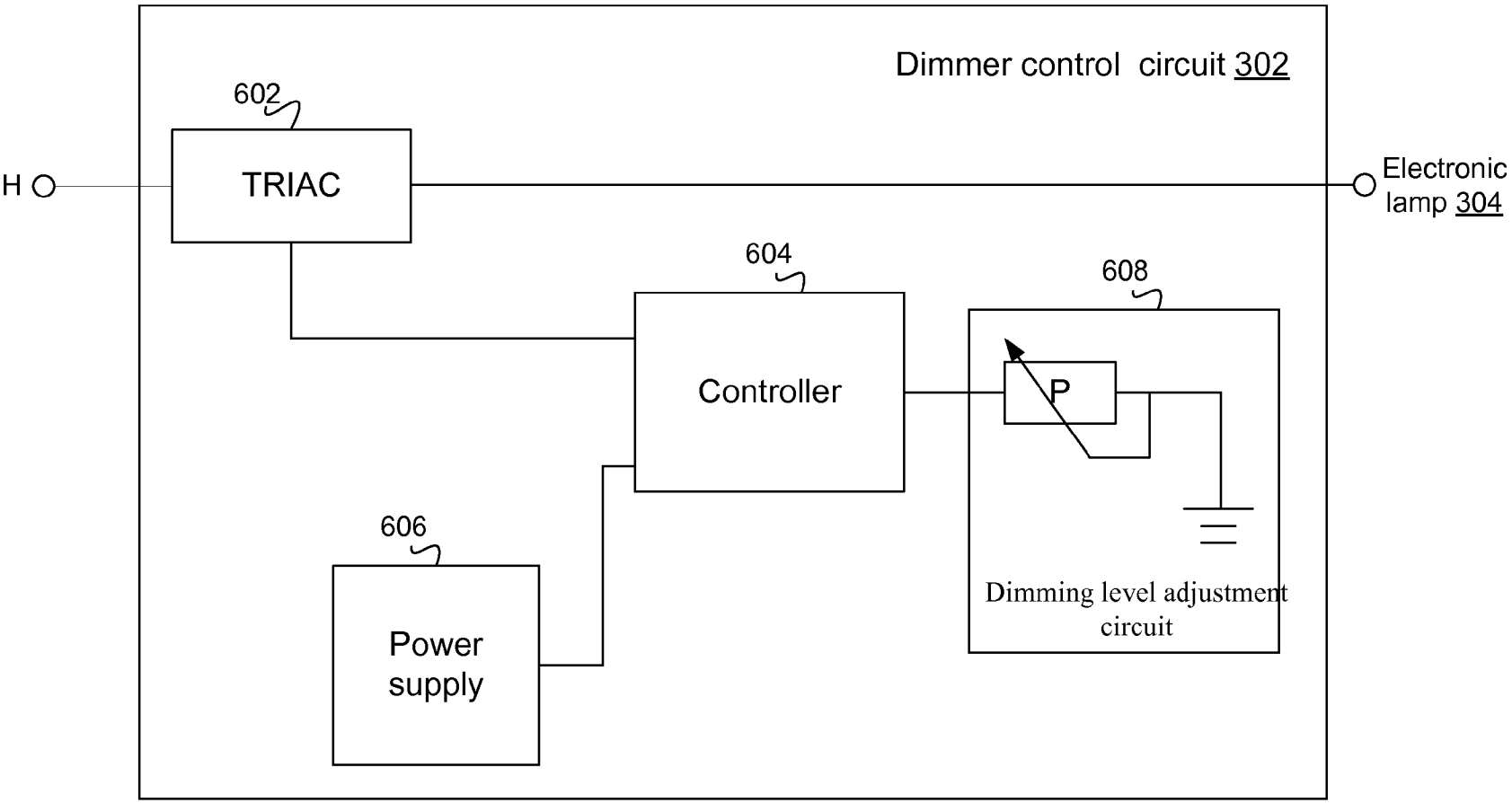
FIG. 6 depicts an example of dimmer control circuit according to one embodiment.

FIG. 6 depicts an example of dimmer control circuit 302 according to one embodiment. Dimmer control circuit 302 includes a TRIAC 602, a controller 604, a power supply 606, and a dimming level adjustment circuit 608. Power supply 606 is used to provide power to controller 604. A power supply for dimmer control circuit 302 is generated without a reference to neutral (ground) because there may be only hot node in dimmer control circuit 302.

Dimming adjustment circuit 608 includes a potentiometer, P, that is used to adjust the dimming level input into controller 604. For example, the resistance of the potentiometer is adjusted to increase or decrease the current input into controller 604. Dimming adjustment circuit 608 also generates a visual ground for dimmer control circuitry 302.

Controller 604 embeds the dimming level into a signal output by TRIAC 602. For example, the non-conduction angle of the signal output by TRIAC 602 is controlled by controller 604 to indicate the dimming level to electronic lamp 304.

Figure 7:
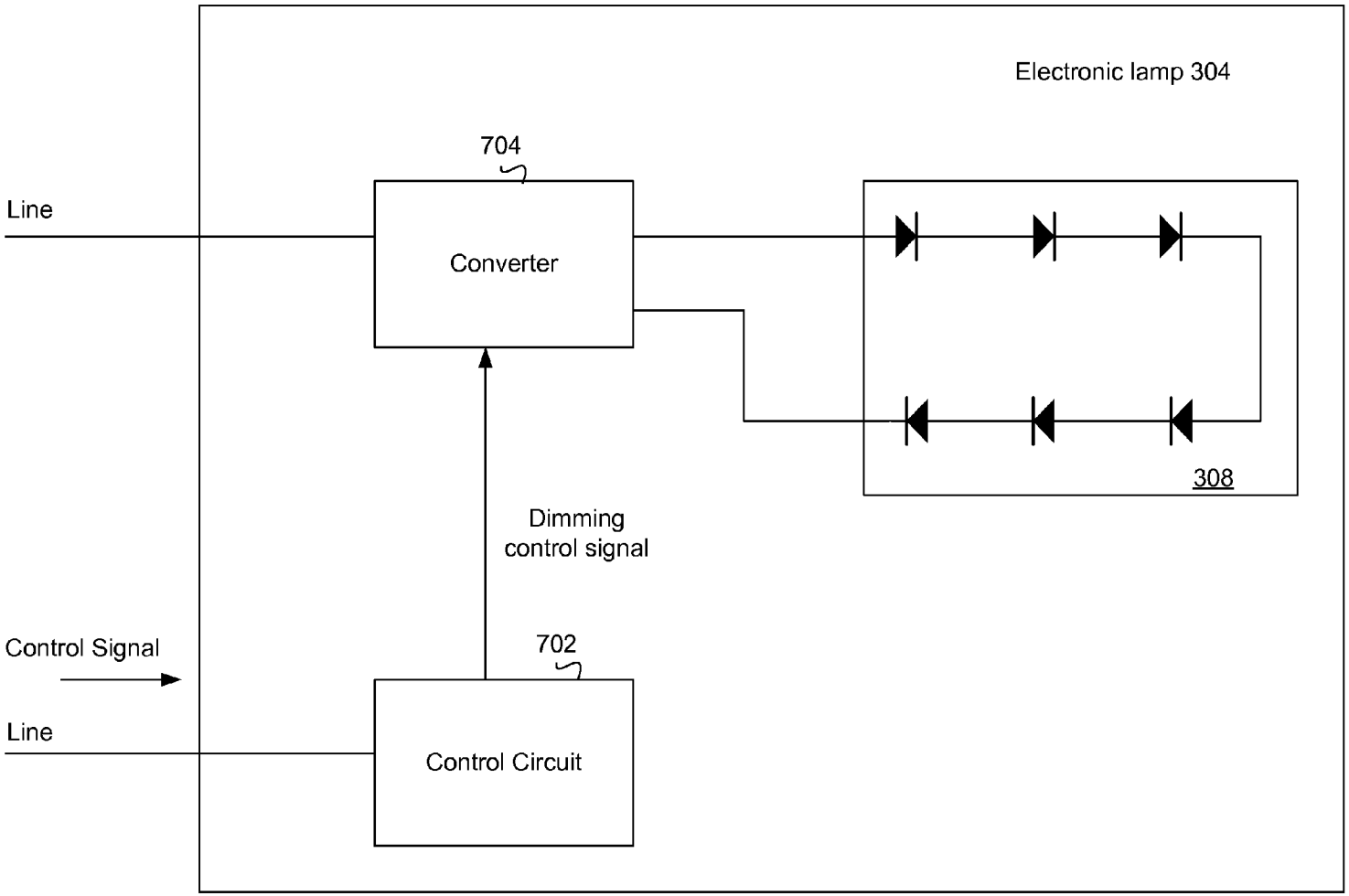
FIG. 7 shows an example of electronic lamp according to one embodiment.

FIG. 7 shows an example of electronic lamp 304 according to one embodiment. A control circuit 702 receives the control signal output by TRIAC 602 that includes an embedded dimming level. Depending on the embedded dimming level, control circuit 702 adjusts the dimming signal and outputs the dimming control signal to a converter 704, which may be a flyback converter. Converter 704 controls the LED current to adjust the dimming level of LEDs 308 based on the received dimming control signal. The dimming control signal from control circuit 702 to converter 704 is decoded by control circuit 702 based on the dimming level embedded in the signal output by TRIAC 602.

Figure 8:
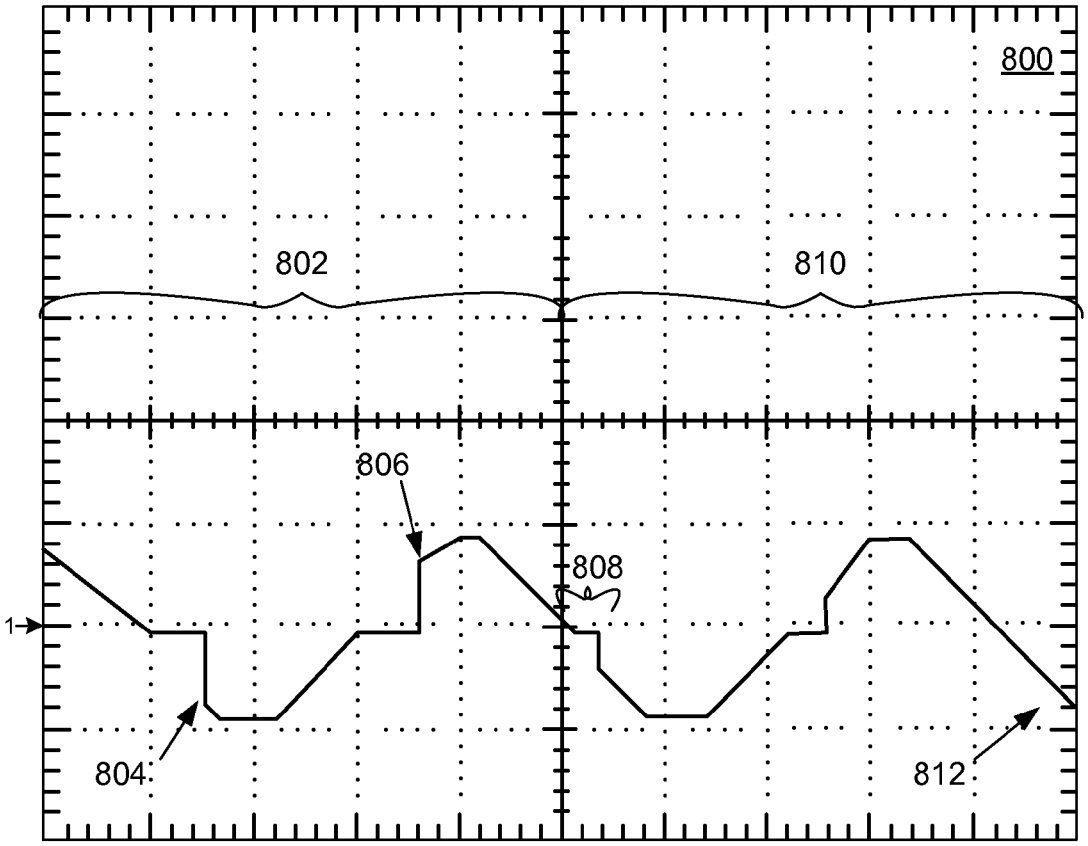
FIG. 8 shows a graph to illustrate the embedded dimming level according to one embodiment.

FIG. 8 shows a graph 800 to illustrate the embedded dimming level according to one embodiment. The waveform shown in FIG. 8 is from the output of TRIAC 602. A first cycle 802 is used to send a pattern to indicate a start cycle. For example, the pattern is provided using a non-conduction angle to indicate the start cycle. Any non-conduction angle may be used, but a 45° non-conduction angle is illustrated in this example. In one embodiment, the pattern is when a non-conduction angle of 45° for both halves of a line cycle is received. As shown, at 804 and 806, the non-conduction angle is 45° for both half-line cycles. At this point, converter control circuit 702 determines that the start signal has been received.

After the start signal is received, the dimming level is sent via the control signal. The dimming level may be sent by interpreting the control signal in a second line cycle at 810. For example, an off time shown at 808 is measured to determine the non-conduction angle. In one example, the ratio of the non-conduction angle for the second line cycle at 810 to the non-conduction angle for start cycle at 802 is used to determine the dimming level. For example, if the non-conduction angle at 808 is 22.5°, then the dimming level is 22.5/45=50% dimming. In this case, the dimming level may be 50%. At 812, the signal sent by TRIAC 602 returns to the normal sinusoidal signal and converter 704 operates under proper dimming level.

Figure 9:
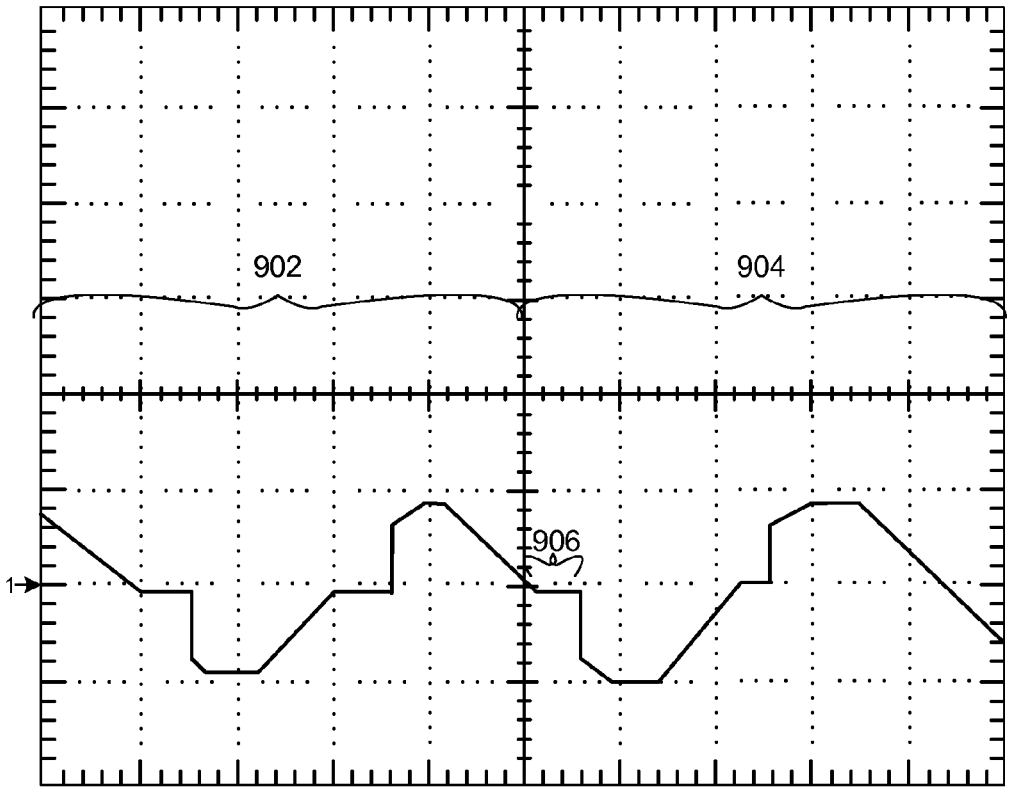
FIG. 9 shows another example of an embedded dimming level at full diming according to one embodiment.

FIG. 9 shows another example of an embedded dimming level at full diming according to one embodiment. At 902, the start cycle is received. In a second line cycle at 904, the off time at 906 is shown. In this case, a 45° non-conduction angle is sent in second line cycle at 904. Because two 45° non-conduction angles are sent in the start cycle and the second line cycle, this indicates full dimming as 45/45=100%. In this case, electronic lamp 304 is almost turned off.

Figure 10:
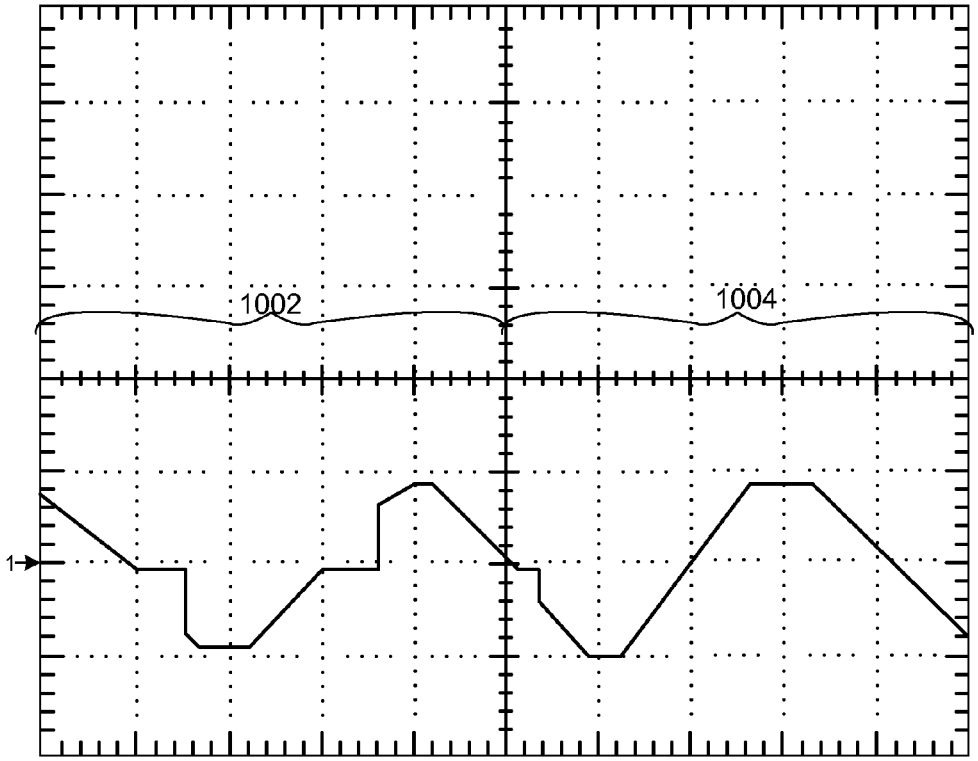
FIG. 10 depicts another example of an embedded dimming level at full power according to one embodiment.

FIG. 10 depicts another example of an embedded dimming level at full power according to one embodiment. A start cycle is received at 1002, and at a second line cycle 1004, the non-conduction angle is almost 0°. This indicates very little dimming or full power as 0/45=0%. The dimming level may be sent as needed and may not be repeated over and over. It will be understood that other schemes may be used to determine the dimming level. For example, different patterns may be used to indicate the start cycle. Further, a ratio of the non-conduction angle in the second line cycle to the start cycle may not be used. Rather, the non-conduction angle in the second line cycle may be interpreted based on another reference to determine the dimming level. Further, the ratio described may be interpreted differently.

Figure 11:
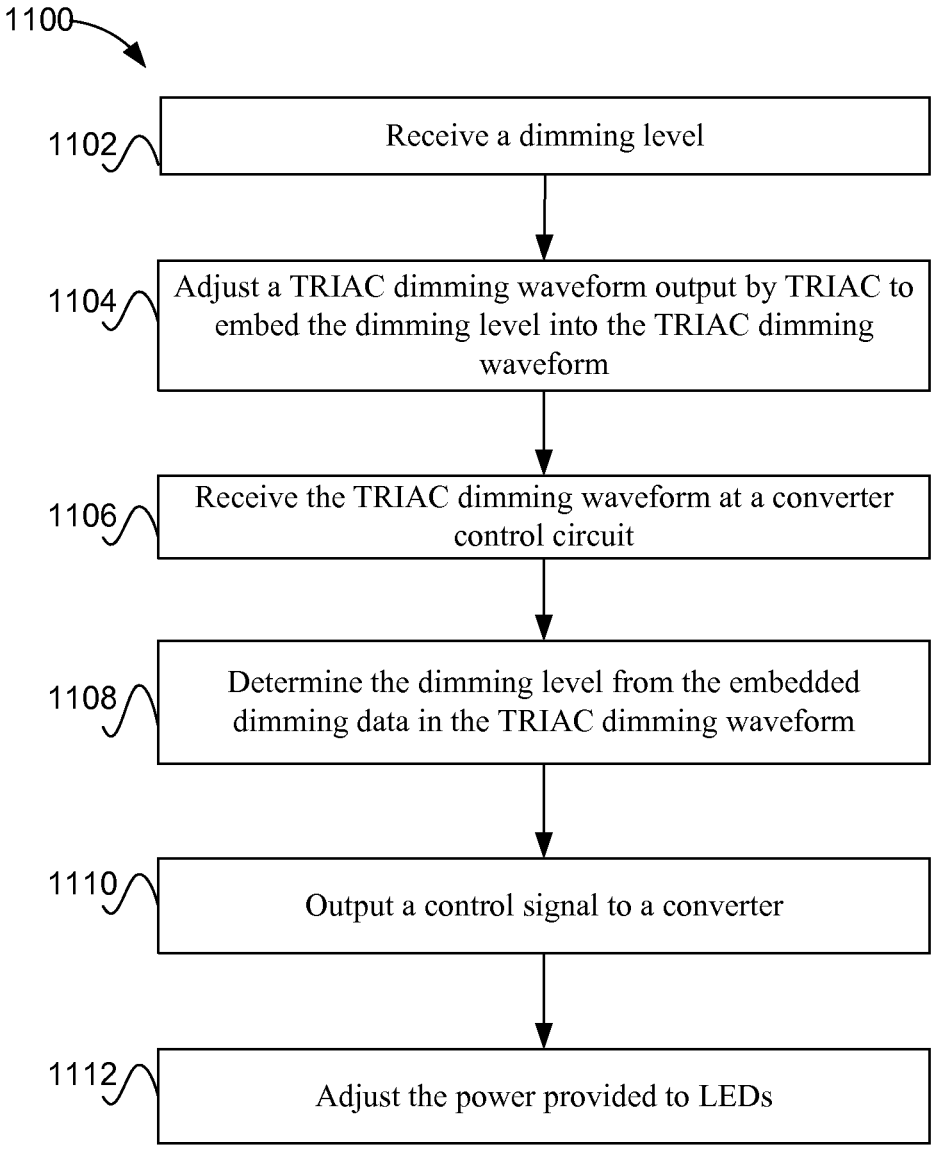
FIG. 11 depicts a simplified flowchart of a method for providing dimming by embedding dimming information in the control signal according to one embodiment.

FIG. 11 depicts a simplified flowchart 1100 of a method for providing dimming by embedding dimming information in the control signal according to one embodiment. At 1102, controller 604 receives a dimming level. At 1104, controller 604 adjusts the control signal output by TRIAC 602 to embed dimming information for the dimming level into the control signal.

Figure 12:
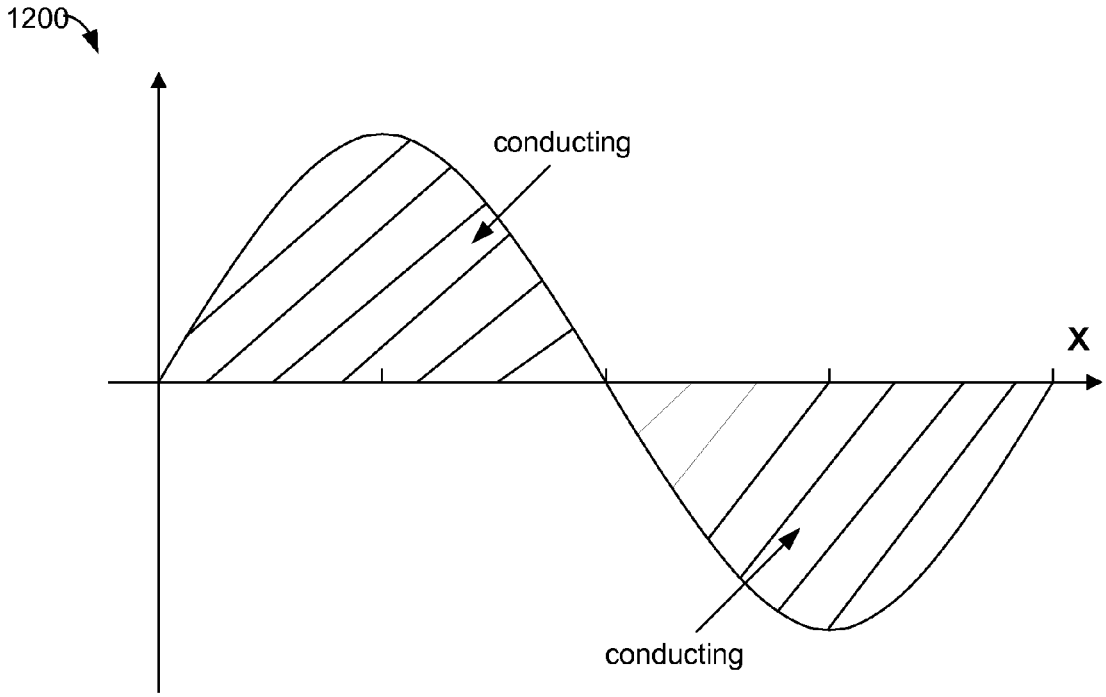
FIG. 12 shows a graph of an input waveform into electronic lamp according to one embodiment.

At 1106, converter control circuit 702 receives the control signal. At 1108, converter control circuit 702 determines the dimming level from the embedded dimming information in the control signal. At 1110, converter control circuit 702 outputs a control signal to converter 704. At 1112, converter 704 adjusts the dimming signal provided to LEDs 308. The power may be adjusted by adjusting a sinusoid signal that is provided to LEDs 308. A waveform as described in FIG. 2 using a forward or reverse phase is not used to control the dimming level of LEDs 308. FIG. 12 shows a graph 1200 of an input waveform into electronic lamp 304 according to one embodiment. The input waveform during the normal operation of lamp 304 is sinusoidal with minimum total harmonic distortion (THD) and high power factor. The waveform is conducting for the both half line cycles.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

The above description illustrates various embodiments of the present invention along with examples of how aspects of the present invention may be implemented. The above examples and embodiments should not be deemed to be the only embodiments, and are presented to illustrate the flexibility and advantages of the present invention as defined by the following claims. Based on the above disclosure and the following claims, other arrangements, embodiments, implementations and equivalents may be employed without departing from the scope of the invention as defined by the claims.

What is claimed is:

1. An apparatus comprising:

circuitry that receives a dimming input to control a dimming level of a lamp; and circuitry that generates a control signal being a sinusoidal signal, the control signal based on the dimming input, wherein the control signal indicates the dimming level for a converter of the lamp, the converter interprets the control signal to control the dimming level of the lamp using the sinusoidal signal.

2. The apparatus of claim 1, wherein the circuitry that generates the control signal is configured to modulate an input signal using a modulation signal that is generated based on the dimming input, the modulation signal including dimming information for the dimming level.

3. The apparatus of claim 2, wherein the modulation signal comprises a first time period in a line cycle including a sinusoidal waveform, wherein the converter uses characteristics of the first time period to determine the dimming level.

4. The apparatus of claim 1, wherein the control signal comprises a pattern based on a non-conduction angle to indicate a start signal.

5. The apparatus of claim 1, wherein the control signal comprises:

a first half of a line cycle having a non-conduction angle of a first value; and a second half of the line cycle of the control signal having a non-conduction angle of a second value, wherein the first value and the second value indicate a start signal.

6. The apparatus of claim 5, wherein:

the line cycle is a first line cycle, and the control signal comprises an off time in a second line cycle after the first line cycle, wherein the off time is used by the converter to determine the dimming level.

7. The apparatus of claim 6, wherein the off time is used to determine the non-conduction angle, wherein a ratio of the non-conduction angle in the first half or the second half of the first line cycle to the non-conduction angle of the second line cycle is used by the converter to determine the dimming level.

8. The apparatus of claim 1, wherein the lamp comprises an electronic lamp.

9. An apparatus comprising:

circuitry that receives a control signal being a sinusoidal signal, the control signal based on a dimming input to control a dimming level of a lamp;

circuitry that interprets the control signal to determine the dimming level for a converter of the lamp; and circuitry that controls the dimming level of the lamp by adjusting a dimming level for a load of the lamp using the sinusoidal signal.

10. The apparatus of claim 9, wherein the circuitry that interprets the control signal is configured to determine a modulation signal in the control signal, the modulation signal including dimming information for the dimming level.

11. The apparatus of claim 10, wherein the modulation signal comprises a first time period in a line cycle including a sinusoidal waveform, wherein the converter uses characteristics of the first time period to determine the dimming level.

12. The apparatus of claim 9, wherein the control signal comprises a pattern based on a non-conduction angle to indicate a start signal.

13. The apparatus of claim 9, wherein the control signal comprises:

a first half of a line cycle having a non-conduction angle of a first value; and a second half of the line cycle of the control signal having a non-conduction angle of a second value, wherein the first value and the second value indicate a start signal.

14. The apparatus of claim 13, wherein:

wherein the line cycle is a first line cycle, and the control signal comprises an off time in a second line cycle after the first line cycle, wherein the off time is used by the converter to determine the dimming level.

15. The apparatus of claim 14, wherein the off time is used to determine the non-conduction angle, wherein a ratio of the non-conduction angle in the first half or the second half of the first line cycle to the non-conduction angle of the second line cycle is used by the converter to determine the dimming level.

16. The apparatus of claim 9, wherein the lamp comprises an electronic lamp.

17. A method comprising:

receiving a dimming input to control a dimming level of a lamp; and generating a control signal being a sinusoidal signal, the control signal based on the dimming input, wherein the control signal indicates the dimming level for a converter of the lamp, the converter interprets the control signal to control the dimming level of the lamp using the sinusoidal signal.

18. The method of claim 17, wherein the control signal comprises an input signal that is modulated based on the dimming level or a start pattern in a first line cycle followed by a non-conduction angle in a second line cycle that is determined based on the dimming level.

19. A method comprising:

receiving a control signal being a sinusoidal signal, the control signal based on a dimming input to control a dimming level of a lamp;

interpreting the control signal to determine the dimming level for a converter of the lamp; and controlling the dimming level of the lamp by adjusting a dimming level for a load of the lamp using the sinusoidal signal.

20. The method of claim 19, wherein the control signal comprises an input signal that is modulated based on the dimming level or a start pattern in a first line cycle followed by a non-conduction angle in a second line cycle that is determined based on the dimming level.

* * * * *